US005340329A

United States Patent [19]

Hirai

[11] Patent Number: 5,340,329

[45] Date of Patent: Aug. 23, 1994

[54] CONNECTOR COMBINATION

[75] Inventor: Yuji Hirai, Tokyo, Japan

[73] Assignee: Honda Tsushin Kogyo Kabushiki Kaisha, Tokyo, Japan

[21] Appl. No.: 42,277

[22] Filed: Apr. 1, 1993

Related U.S. Application Data

[63] Continuation-in-part of Ser. No. 868,177, Apr. 14, 1992, abandoned.

[30] Foreign Application Priority Data

Feb. 28, 1992 [JP] Japan ..... 4-9929[U]

[51] Int. Cl.[5] ..... H01R 13/627

[52] U.S. Cl. ..... 439/357; 439/610

[58] Field of Search ..... 439/75, 359, 362, 364, 439/365, 358, 372, 92, 357, 352, 607, 610

[56] References Cited

U.S. PATENT DOCUMENTS

| | | | |
|---|---|---|---|
| 4,456,319 | 6/1984 | Poulain Ricros | 439/75 |
| 4,634,203 | 1/1987 | Noyes | 439/359 |
| 4,740,173 | 4/1988 | Justiano et al. | 439/357 |
| 4,923,409 | 5/1990 | Ishii | 439/357 |
| 4,929,185 | 5/1990 | Wong et al. | 439/75 |
| 5,088,935 | 2/1929 | Dise et al. | 439/564 |

*Primary Examiner*—Larry I. Schwartz
*Assistant Examiner*—Hien D. Vu
*Attorney, Agent, or Firm*—Armstrong, Westerman, Hattori, McLeland & Naughton

[57] ABSTRACT

A lock piece engaging member of a connector has a cylindrical main body which has, in an intermediate portion thereof, a small-diameter portion and, on one end thereof, a large-diameter engaging portion. It has also a fastening thread which is provided on the other end of the cylindrical metallic main body and extends in an axial direction thereof, and a tightening groove which is formed on an end surface of the engaging portion, such that the lock piece engaging member is screwed by the fastening thread into the connector main body. A mating connector has, on each side, an electrically conductive plate-like lock piece provided with an engaging window at one end and a pressed portion with a lock spring at the other end. In releasing the engagement between the connector and the mating connector, pressing portions of the lock pieces are pressed inwards.

7 Claims, 3 Drawing Sheets

PRIOR ART FIG.4(A)
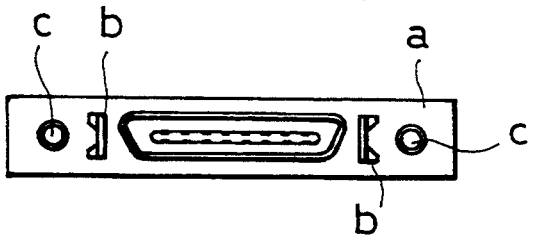
PRIOR ART FIG.4(B)
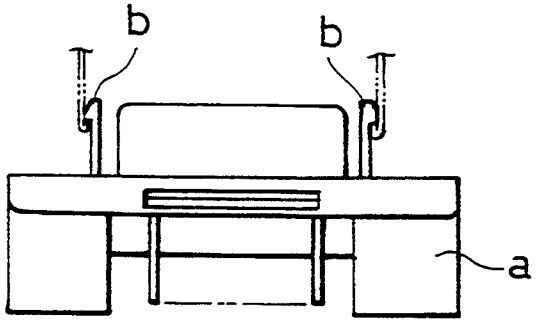

CONNECTOR COMBINATION

This application is a continuation-in-part application of U.S. Ser. No. 868,177, filed Apr. 14, 1992, now abandoned.

BACKGROUND OF THE INVENTION

This invention relates to a connector combination which is particularly suitable for a small-sized electronic equipment.

As a connector combination there is conventionally known one as shown in FIGS. 4(A) and 4(B), which comprises a connector main body "a" made of zinc- or aluminum-alloy die casting, and lock piece engaging means b which are integrally provided in a projecting manner on the connector main body and are engaged with lock pieces of a mating connector (not shown) when the mating connector is fitted into the connector. The connector is also provided, in close proximity to the lock piece engaging means, with threaded holes c for mounting the connector on a panel.

As described above, since the connector main body of the conventional connector is made of zinc- or aluminum-alloy die casting, the cost becomes high. In addition, since the lock piece engaging means b and the threaded holes c for mounting the connector on the panel are provided in separate positions of the connector main body, the connector main body becomes large in length, this being a hindrance to small-sized connectors.

OBJECT AND SUMMARY OF THE INVENTION

This invention has an object of providing a connector combination which solves the above-mentioned disadvantages.

According to this invention, the foregoing and other objects are attained by a connector combination, comprising: a mating connector comprising a pair of right and left lock pieces each provided with an engaging window at one end and a pressed portion with a lock spring at the other end, the lock piece being made of an electrically conductive elastic metallic thin plate; a connector comprising a connector main body provided with a pair of right and left mounting portions, and a lock piece engaging means which is provided at each of the mounting portions and which engages with each of the lock pieces of the mating connector when the mating connector is fitted into the connector, each of the lock piece engaging means comprising: a mount-piece main body provided with a small-diameter portion at an intermediate position of the mount-piece main body and a large-diameter engaging portion at one end of the mount-piece main body, the large-diameter portion engaging with the engaging window of each lock piece when the mating connector is fitted into the connector; a fastening thread which is provided on the other end of the mount-piece main body and extends in an axial direction thereof; and tightening means which is formed at an end of the engaging portion, such that the lock piece engaging means is screwed by the fastening thread into the connector main body.

In the above-mentioned construction, the lock piece engaging means comprises a mount-piece main body having in an intermediate portion thereof a small-diameter portion and a fastening thread which is provided to extend in an axial direction of the mount-piece main body so that the lock piece engaging means is screwed into the connector main body. Therefore, the connector main body can be mounted on a panel at the time of screwing the lock piece engaging means. Since the position at which the lock piece engaging means is provided on the connector main body and the position at which the connector is mounted on the panel are arranged to be in the same position, the connector main body can be made smaller in length than the conventional one.

In a preferred embodiment, the electrically conductive elastic thin plate is made of a stainless steel and the connector main body is made of a synthetic resin. The lock piece is arranged to be swingable about a shaft portion which is formed by a substantially rounded protrusion integrally provided in the lock piece and the shaft portion is inserted into a bearing recess which is formed in a casing of the mating connector. The lock piece engaging means is substantially cylindrical in shape. The tightening means is a slotted type slot formed on an end surface of the engaging portion. By making this lock piece engaging means substantially cylindrical in shape, it can be manufactured easily by machining work.

BRIEF DESCRIPTION OF THE DRAWINGS

The above and other objects and the attendant advantages of this invention will become readily apparent by reference to the following detailed description when considered in conjunction with the accompanying drawings wherein:

FIGS. 3(A) through 3(F) show a mating connector, of the connector combination, of this invention to be fitted into the connector, partly shown as fitted with the connector, wherein:

FIG. 3(A) is a side view, partly in section, of the mating connector;

FIG. 3(B) is a side view, partly in section, of the mating connector with the connector fitted thereinto;

FIG. 3(C) is a side view, partly in section, with further internal details of the mating connector with the connector fitted thereinto;

FIG. 3(D) is a cross-sectional view as viewed along the line D—D in FIG. 3(B);

FIG. 3(E) is a front view of a lock piece; and

FIG. 3(F) is a perspective view of the lock piece shown in FIG. 3(E);

FIG. 4A is a front view of a conventional connector with a lock piece engaging member; and FIG. 4B is a plan view thereof.

DETAILED DESCRIPTION OF A PREFERRED EMBODIMENT

A preferred embodiment of this invention will now be explained with reference to the accompanying drawings.

Figure 1:
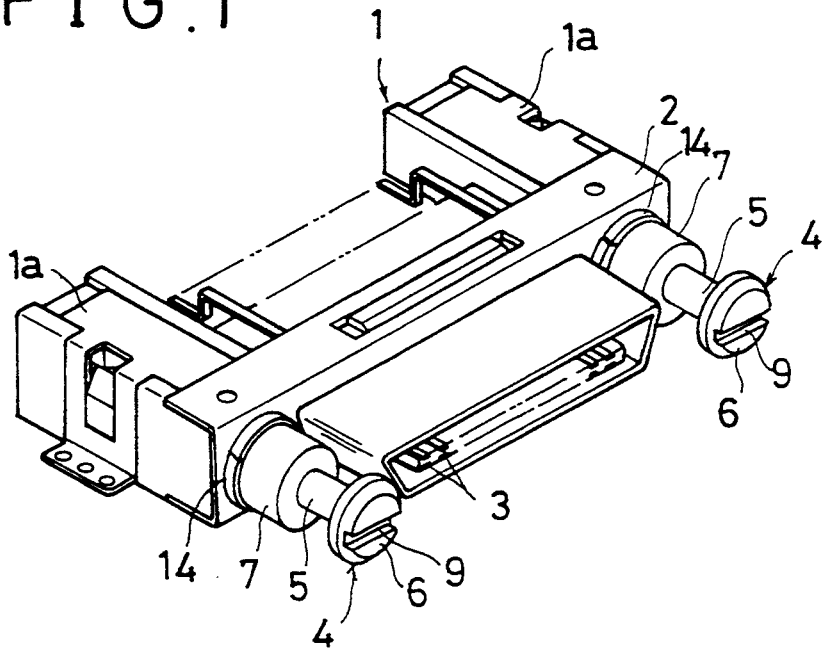
FIG. 1 is a perspective view of one example of a connector, of a connector combination, of this invention.
Figure 2:
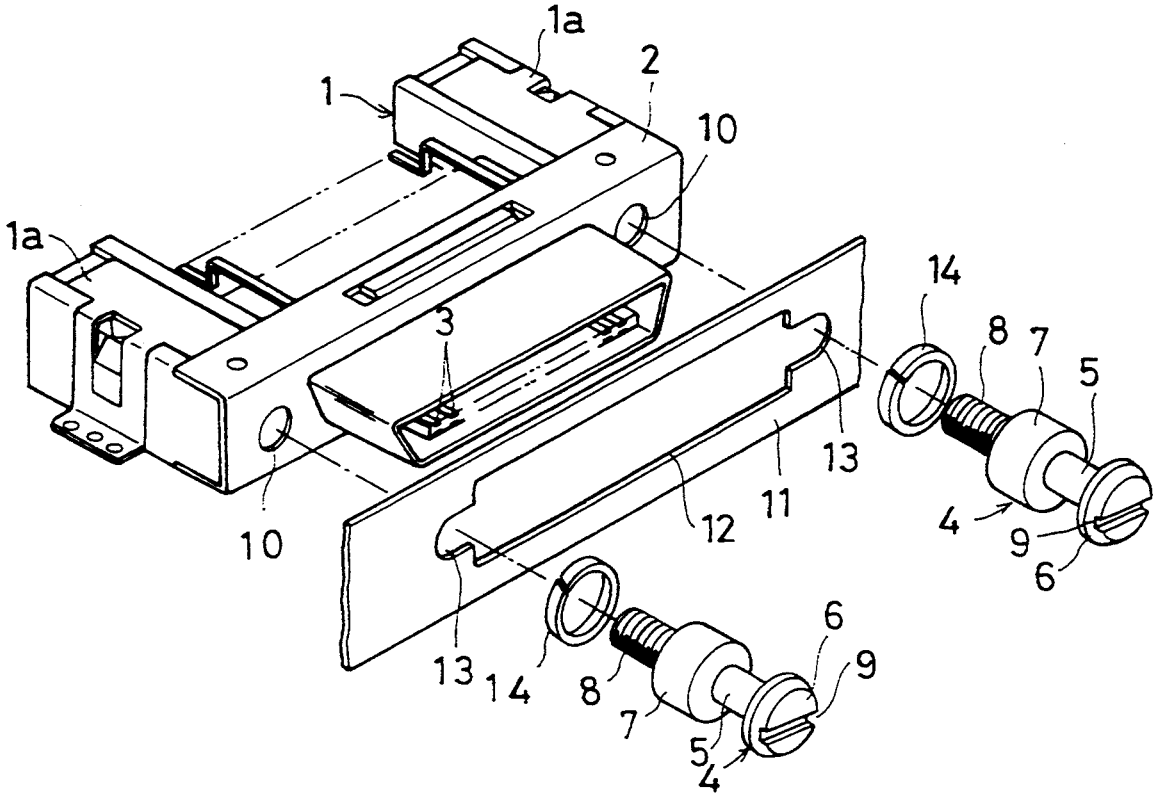
FIG. 2 is a perspective exploded view showing the relationship between a panel and the connector, of the connector combination, of this invention.

FIGS. 1 and 2 show one example of a connector with a lock piece engaging means of this invention.

In the Figures, numeral 1 denotes a connector itself or a connector main body which comprises a pair of right and left mounting portions 1*a*, 1*a* for fixing the connector to a printed wiring board by soldering or the like. The connector main body 1 is made, for example, of a synthetic resin covered with a metallic shell 2. On both sides of that fitting portion of the connector main body 1 which has enclosed therein electric contacts 3, i.e., at each of the mounting portions 1*a*, 1*a*, there are fastened lock piece engaging members 4, 4.

Each of the lock piece engaging members 4 comprises: as shown in FIG. 2, a mount-piece main body in the form of a cylindrical main body 7 having, in an intermediate portion thereof, a small-diameter portion 5 and, on one end thereof, a large-diameter engaging portion 6; and a fastening thread 8 which is integrally provided to extend in an axial direction of the cylindrical main body 7. On an external end of the engaging portion 6, there is formed a tightening means in the form of a slotted type slot 9 with which a screw driver, for example, is operatively engaged. A taper is formed on the periphery of the end surface of the engaging portion 6 in such a manner as to facilitate engagement into a mating connector which is described hereinbelow.

This lock piece engaging member 4 is fastened into the connector main body 1 by fitting its fastening thread 8, through a perforation 10 in the connector main body 1, into a nut (not shown) which is fitted into a dented portion (not shown) which is in communication with the perforation 10. When this lock piece engaging member 4 is tightened up, the fitting portion of the connector main body 1 is inserted into a hole 12 in the panel 11 as shown in FIG. 2. The fastening thread 8 of the lock piece engaging member 4 is then screwed into the nut through a notched portion 13 in the panel 11. The connector main body 1 can thus be mounted on the panel 11. In FIGS. 1 and 2, numeral 14 denotes a spring washer.

FIGS. 3(A) through 3(F) show the mating connector which is to be fitted into the connector of the above-mentioned embodiment, partly in a condition in which the connector and the mating connector are fitted together.

In the Figures, numeral 16 denotes a cover made of an electrically insulating material, e.g., a synthetic resin, for containing therein the mating connector 17 connected to a cable 22. On each side of this cover 16 there is respectively formed a pressing portion 18. Each of the pressing portions 18 is part of the cover 16 but is partly split apart from the remaining part of the cover 16 in the longitudinal or axial direction so that the pressing portion 18 can be flexibly bent inwards when pressed with fingers. On an inner side of each pressing portion 18, there is respectively disposed a plate-like lock piece 20 such that it extends to the front end (i.e., the end which faces the connector main body 1) of the mating connector 17. This plate-like lock piece 20 is made up of an electrically conductive metallic thin plate having an elasticity or a springing feature such, for example, as a stainless steel. Each of these plate-like lock pieces 20 is provided at its front end with an engaging window 21 and, at its opposite end, with a pressed portion (i.e., a portion to be pressed by the pressing portion 18) having a lock spring 20*a* which extends inwards. This plate-like lock piece 20 is so arranged as to be rotatable or swingable about a shaft portion 19, which is described hereinbelow, when the flexible pressing portions 18 are pressed towards each other. The shaft portion 19 of the plate-like lock piece 20 is constructed as shown in detail in FIGS. 3(E) and 3(F). Namely, a substantially semicircular protrusion is formed on one side and two pieces of similar protrusion are formed on the other side so that altogether a substantially round opening or a tunnel is formed in between in the lateral direction of an intermediate portion of the lock piece 20. The shaft portion 19 thus formed is supported by inserting or fitting it into a bearing portion 23 to be formed in the cover 16. This bearing portion 23 is formed, for example, by forming a substantially semicircular dented portion in an appropriate part of the cover and another similar dented portion formed in a supporting member 30 which is longitudinally provided inside the cover 16 in a portion opposite the former dented portion. In this manner, a substantially circular opening is formed together for receiving therein the shaft portion 19.

Figure 3A:
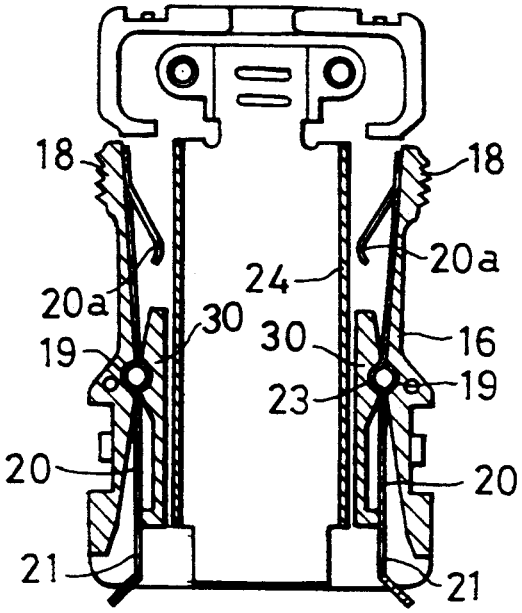
Figure 3B:
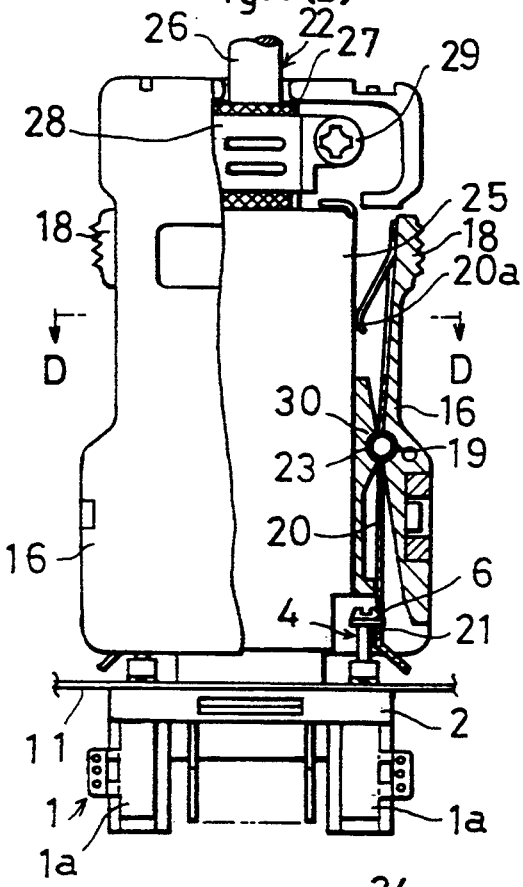
Figure 3C:
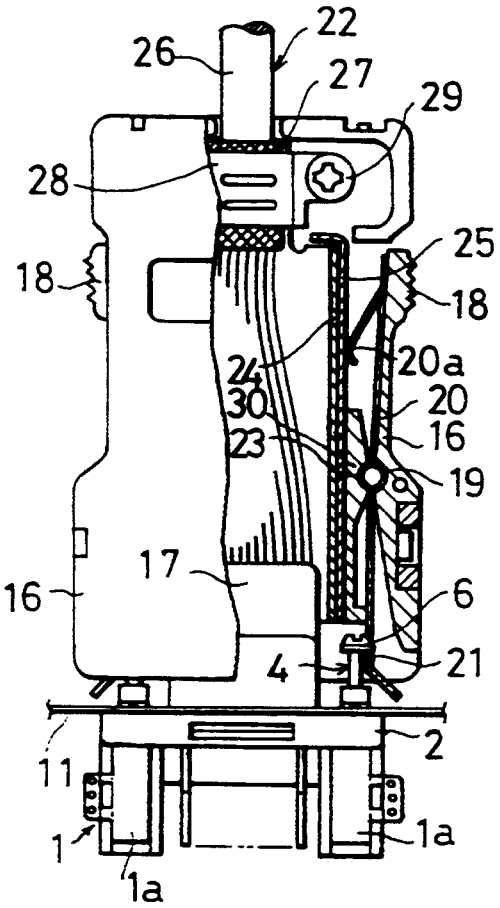
Figure 3D:
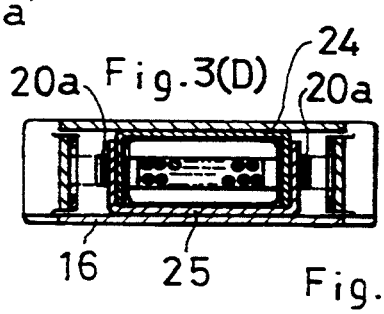
Figure 3E:
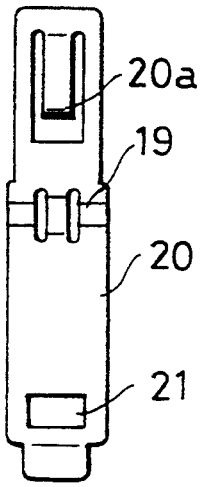
Figure 3F:
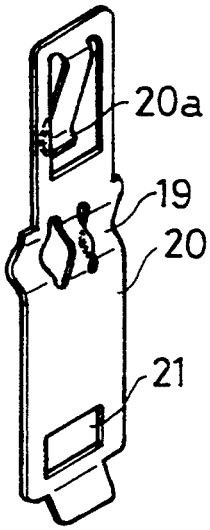

When the mating connector 17 is to be fitted into the connector, the engaging portions 6 of the lock piece engaging member 4 are engaged with the windows 21, as shown for example in FIG. 3(B), to prevent both connectors from being disengaged. When the connector and the mating connector are to be disengaged from each other, the flexible pressing portions 18 are pressed towards each other and, by this pressing force, the plate-like lock pieces 20 are rotated against the spring force of the lock springs 20*a*. The windows 21 are swung away from the engaging portions 6, thereby releasing the engagement of the windows 21 with the lock piece engaging members 4.

Inside the cover 16 there are disposed an electrically conductive inner metallic shell 24 and an electrically conductive outer metallic shell 25, each having a [-shaped cross-section. This electrically conductive outer metallic shell 25 becomes electrically conductive to the plate-like lock piece 20 when the lock spring 20*a* of the lock piece 20 is urged against the electrically conductive outer metallic shell 25. Cable shield braiding wire 27 which is exposed from an electrically insulating cable jacket 26 is caused to be electrically conductive by tightening it by an electrically conductive metallic cable shield clamp 28 to the electrically conductive inner metallic shell 24 by means of screws 29. In this manner, when the mating connector is fitted into the electrically conductive metallic panel 11 which is placed on a front surface of an electric apparatus box or cabinet and on which the connector main body 1 is mounted by means of the lock piece engaging member 4, the cable shield braiding 27 of the cable 22 is caused to be electrically conductive to the electrically conductive metallic panel 11 via the electrically conductive inner metallic shell 24, the electrically conductive outer metallic shell 25, the lock piece 20 and the lock piece engaging member 4. By this electric conduction, the electric magnetic interference characteristics against the external noises, radiative noises, or the like are improved.

It can be added that the groove of the tightening means may be of a Phillips type slot instead of a slotted type slot. The tightening means may further have a hexagonal or square external shape for operatively engaging with a suitable tightening tool. The lock piece engaging means may be made of an easily machinable and electrically conductive material such, for example, as a metal.

Since this invention has the above-mentioned construction, the lock piece engaging member can, through its engagement with the lock piece, prevent the connector from being disengaged from the mating connector and, in addition, mount the connector main body on the panel. Therefore, there is an effect in that the connector can be made smaller in size and lower in cost.

Further, since the plate-like lock piece is made of an electrically conductive elastic metallic thin plate, when it is used, e.g., for an interface (I/O) connector, it can stand due to its stoutness or toughness repeated operations of engagement and disengagement of, e.g., above 5000 times.

It is readily apparent that the above-mentioned connector combination has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A connector combination, comprising:

mating connector means comprising:

an electrically insulating cover, a mating connector to which a cable is connected, an electrically conductive metallic shell with which a cable shield braiding wire is brought into electrically conductive contact and which encloses a core wire of the cable, and a pair of right and left lock pieces, said mating connector, said electrically conductive metallic shell and said lock pieces being contained inside said electrically insulating cover, each of said lock pieces comprising an electrically conductive elastic metallic thin plate, and having on one end thereof an engaging window and on an opposite end thereof a pressed portion having a lock spring, said lock spring being arranged to be urgingly contacted with said electrically conductive metallic shell;

a connector means comprising a connector main body provided with a pair of right and left mounting portions, and an electrically conductive lock piece engaging means which is provided at each of said mounting portions and which engages with each of said lock pieces of the mating connector when said mating connector is fitted into said connector, each of said lock pieces engaging means comprising:

a mount-piece main body provided with a small-diameter portion at an intermediate position of the mount-piece main body and a large-diameter engaging portion at one end of the mount-piece main body, said large-diameter portion engaging with said engaging window of said each lock piece when said mating connector is fitted into said connector;

a fastening thread which is provided on the other end of said mount-piece main body and extends in an axial direction thereof; and tightening means which is formed at an end of said engaging portion, such that said lock piece engaging means is screwed by said fastening thread into said connector main body.

2. A connector combination according to claim 1, wherein said electrically conductive elastic thin plate is a stainless steel.

3. A connector combination according to claim 2, wherein said lock piece is swingable about a shaft portion which is formed by a substantially rounded protrusion integrally provided in said lock piece, said shaft portion being inserted into a bearing recess which is formed in a casing of said mating connector.

4. A connector combination according to claim 1, wherein said fastening thread is arranged to be fastened to said connector main body through a panel.

5. A connector combination according to claim 1, wherein said lock piece engaging means is substantially cylindrical in shape.

6. A connector combination according to claim 1, wherein said tightening means is a groove formed on an end surface of said engaging portion.

7. A connector combination according to claim 1, wherein said connector main body is made of a synthetic resin.

* * * * *